US007475642B2

(12) United States Patent
Shenghao et al.

(10) Patent No.: US 7,475,642 B2
(45) **Date of Patent: *Jan. 13, 2009**

(54) TABLE HAVING H-CENTER SUPPORT ASSEMBLY

(75) Inventors: Jin Shenghao, Xiamen (CN); Chen Zhurong, Xiamen (CN); Arvin Patel, Sunnyvale, CA (US)

(73) Assignee: Lifetime Products, Inc., Clearfield, UT (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/669,740

(22) Filed: Sep. 24, 2003

(65) Prior Publication Data

US 2004/0187748 A1 Sep. 30, 2004

(30) Foreign Application Priority Data

Sep. 27, 2002 (CN) ..... 02 2 59585 U

(51) Int. Cl.
*A47B 3/00* (2006.01)

(52) U.S. Cl. ..... 108/132

(58) Field of Classification Search ..... 108/132, 108/130, 131, 133, 129; 248/188.06
See application file for complete search history.

(56) References Cited

U.S. PATENT DOCUMENTS

| | | | |
|---|---|---|---|
| 236,197 | A | 1/1881 | Valley |
| 236,741 | A | 1/1881 | Weaver |
| 769,354 | A | 9/1904 | Mielsen |
| 1,063,642 | A | 6/1913 | Birdsall |
| 1,266,929 | A | 5/1918 | Enis |
| 1,272,187 | A | 7/1918 | Basford |
| 1,296,336 | A | 3/1919 | Stine |
| 1,351,013 | A | 8/1920 | Stine |
| 1,514,418 | A | 11/1924 | Battenfeld |

(Continued)

FOREIGN PATENT DOCUMENTS

| | | |
|---|---|---|
| AU | 223700 | 5/1958 |

(Continued)

OTHER PUBLICATIONS

*International Preliminary Report on Patentability*; International Application No. PCT/IB03/04782 (published as WO 2004/028296); 3 pages.

(Continued)

*Primary Examiner*—Janet M Wilkens
*Assistant Examiner*—Timothy M Ayres
(74) *Attorney, Agent, or Firm*—Workman Nydegger

(57) ABSTRACT

A table includes a table top and a table frame. The table frame preferably includes one or more side rails, end rails, table legs, and support braces. The table also includes a mounting structure that is provided on the underside of the table top. At least a portion of a support assembly is connected to the mounting structure. Desirably, the mounting structure and the support assembly are disposed towards the center portion of the table, but the mounting structure and/or support assembly could be located in any desired portion of the table. Preferably, one end of the support braces is pivotally attached to the support assembly and the other end is pivotally attached to a table leg. Advantageously, the support assembly provides a "planar" support area to a portion of the table top.

12 Claims, 4 Drawing Sheets

U.S. PATENT DOCUMENTS

| | | | |
|---|---|---|---|
| 1,594,572 | A | 8/1926 | Soltesz |
| 1,659,840 | A | 2/1928 | Smith |
| 1,757,260 | A | 5/1930 | Silverman |
| 1,765,766 | A | 6/1930 | Lyon |
| 1,823,484 | A | 9/1931 | Blumenthal |
| 1,836,843 | A | 12/1931 | Temple |
| 1,836,934 | A | 12/1931 | Morecroft |
| 1,888,117 | A | 11/1932 | Fox |
| 1,956,946 | A | 5/1934 | Duffy |
| 2,109,869 | A | 3/1938 | Ross |
| 2,257,550 | A | 9/1941 | Gay |
| 2,278,810 | A | 4/1942 | Virtue |
| 2,326,461 | A | 8/1943 | Howe |
| 2,411,658 | A | 11/1946 | La Rue |
| 2,452,169 | A | 10/1948 | Wells |
| 2,470,869 | A | 5/1949 | Schmidt |
| 2,512,473 | A | 6/1950 | Alch |
| 2,522,642 | A | 9/1950 | Schmidt |
| 2,524,198 | A | 10/1950 | La Rue |
| 2,548,682 | A | 4/1951 | Price |
| 2,558,465 | A | 6/1951 | Seymour |
| 2,568,622 | A | 9/1951 | Hagan |
| 2,579,924 | A | 12/1951 | Krasney |
| 2,583,247 | A | 1/1952 | Aja et al. |
| 2,621,710 | A | 12/1952 | Miller |
| 2,647,562 | A | 8/1953 | Hoffar |
| 2,661,792 | A | 12/1953 | Lysaght |
| 2,670,031 | A | 2/1954 | Melges |
| 2,689,158 | A | 9/1954 | Mahr |
| 2,690,210 | A | 9/1954 | Holick |
| 2,717,028 | A | 9/1955 | Villemune |
| 2,717,631 | A | 9/1955 | Howe |
| 2,722,971 | A | 11/1955 | Gallagher et al. |
| 2,748,837 | A | 6/1956 | Beller |
| 2,752,987 | A | 7/1956 | Smithers |
| 2,756,082 | A | 7/1956 | Pucci |
| 2,766,812 | A | 10/1956 | Schrader |
| 2,771,937 | A | 11/1956 | Wilson |
| 2,780,506 | A | 2/1957 | Howe |
| 2,788,059 | A | 4/1957 | Mackintosh |
| 2,800,379 | A | 7/1957 | Smithers |
| 2,805,708 | A | 8/1957 | Bohn |
| 2,811,197 | A | 10/1957 | Nimmo |
| 2,811,400 | A | 10/1957 | James |
| 2,825,390 | A | 3/1958 | Post |
| 2,831,688 | A | 4/1958 | Knox |
| 2,837,141 | A | 6/1958 | Shore |
| 2,849,053 | A | 8/1958 | Beller et al. |
| 2,878,589 | A | 3/1959 | Howe et al. |
| 2,936,820 | A | 5/1960 | Blink et al. |
| 2,939,516 | A | 6/1960 | Drew |
| 2,959,209 | A | 11/1960 | Lakin |
| 2,964,368 | A | 12/1960 | Heyer |
| 2,978,754 | A | 4/1961 | Wilson |
| 2,983,308 | A | 5/1961 | Horowitz |
| 2,992,043 | A | 7/1961 | Nelson |
| 2,999,729 | A | 9/1961 | Semmelroth |
| 3,025,120 | A | 3/1962 | Howe |
| 3,027,209 | A | 3/1962 | Nielsen |
| 3,030,728 | A | 4/1962 | Wesman |
| 3,041,775 | A | 7/1962 | Brown, Jr. et al. |
| 3,079,197 | A | 2/1963 | Mugler |
| 3,080,193 | A | 3/1963 | Nimmo |
| 3,093,924 | A | 6/1963 | Pompa |
| 3,096,866 | A | 7/1963 | Glass |
| 3,101,062 | A | 8/1963 | Kanzelberger |
| 3,112,954 | A | 12/1963 | Kanitz |
| 3,141,424 | A | 7/1964 | Seymour |
| 3,143,982 | A | 8/1964 | Blink et al. |
| 3,144,236 | A | 8/1964 | Clanin |
| 3,166,029 | A | 1/1965 | Acton |
| 3,174,796 | A | 3/1965 | Brown |
| 3,191,991 | A | 6/1965 | Anderson et al. |
| 3,256,037 | A | 6/1966 | Giambalvo |
| 3,259,426 | A | 7/1966 | Shaw et al. |
| 3,267,886 | A | 8/1966 | Glass |
| 3,273,936 | A | 9/1966 | Deavers |
| 3,276,815 | A | 10/1966 | Cardy |
| 3,337,262 | A | 8/1967 | Katzfey et al. |
| 3,349,728 | A | 10/1967 | Barecki et al. |
| 3,353,867 | A | 11/1967 | Anderson |
| 3,357,729 | A | 12/1967 | Krueger |
| 3,410,232 | A | 11/1968 | Krueger |
| 3,429,283 | A | 2/1969 | Uhor |
| 3,439,634 | A | 4/1969 | Bender |
| 3,545,738 | A | 12/1970 | Stagg |
| 3,574,393 | A | 4/1971 | Hughes |
| 3,580,632 | A | 5/1971 | Seymour |
| 3,650,560 | A | 3/1972 | Wohlk |
| 3,672,719 | A | 6/1972 | Haukedahl |
| 3,692,358 | A | 9/1972 | Sung |
| 3,731,971 | A | 5/1973 | Siogren |
| 3,762,626 | A | 10/1973 | Dorsey |
| 3,765,719 | A | 10/1973 | Silver |
| 3,769,920 | A | 11/1973 | Weiss |
| 3,788,696 | A | 1/1974 | Loewen |
| 3,797,884 | A | 3/1974 | Gutierrez |
| 3,857,343 | A | 12/1974 | Greenberg |
| 3,885,829 | A | 5/1975 | Haeger |
| 3,893,400 | A | 7/1975 | Grant |
| 3,905,478 | A | 9/1975 | Peterson et al. |
| 3,922,408 | A | 11/1975 | Smith |
| 3,960,354 | A | 6/1976 | Simikoski |
| 3,994,527 | A | 11/1976 | Nikitits et al. |
| 4,040,658 | A | 8/1977 | Mayol |
| 4,043,277 | A | 8/1977 | Wallace |
| 4,047,754 | A | 9/1977 | Cathey |
| 4,052,100 | A | 10/1977 | Nikitits et al. |
| 4,060,275 | A | 11/1977 | Hansen |
| 4,064,812 | A | 12/1977 | Commanda |
| 4,064,815 | A | 12/1977 | Baum |
| 4,070,057 | A | 1/1978 | Jones |
| 4,072,231 | A | 2/1978 | Helms |
| 4,111,482 | A | 9/1978 | Jones |
| 4,131,311 | A | 12/1978 | Nikitits et al. |
| 4,157,089 | A | 6/1979 | Loughrey |
| 4,191,111 | A | 3/1980 | Emmert |
| RE30,274 | E | 5/1980 | Bolon et al. |
| 4,249,773 | A | 2/1981 | Giambalvo |
| 4,289,350 | A | 9/1981 | Thomas et al. |
| 4,330,151 | A | 5/1982 | Healey |
| 4,382,627 | A | 5/1983 | Dean |
| 4,415,199 | A | 11/1983 | Wright |
| 4,438,603 | A | 3/1984 | Durkan, Jr. |
| 4,462,636 | A | 7/1984 | Markson |
| 4,471,969 | A | 9/1984 | Zabala et al. |
| 4,489,661 | A | 12/1984 | Fitzgerald |
| 4,537,443 | A | 8/1985 | Bray |
| 4,538,526 | A | 9/1985 | Seeley |
| 4,557,200 | A | 12/1985 | Geschwender |
| 4,572,574 | A | 2/1986 | Fishhaber et al. |
| 4,596,196 | A | 6/1986 | Gunter et al. |
| 4,606,575 | A | 8/1986 | Kodet |
| 4,648,652 | A | 3/1987 | Van Kuren |
| 4,653,804 | A | 3/1987 | Yoo et al. |
| 4,700,987 | A | 10/1987 | Sraka et al. |
| 4,740,032 | A | 4/1988 | Olsen et al. |
| 4,744,309 | A | 5/1988 | Kiesel et al. |
| 4,762,321 | A | 8/1988 | Chang |
| 4,815,394 | A | 3/1989 | Ettlinger et al. |
| 4,817,902 | A | 4/1989 | Mason |
| 4,822,066 | A | 4/1989 | Rehrig |
| 4,826,244 | A | 5/1989 | Choi |
| 4,834,450 | A | 5/1989 | Stickler |

| | | | |
|---|---|---|---|
| 4,841,877 | A | 6/1989 | Virtue |
| 4,841,879 | A | 6/1989 | Ferguson |
| 4,864,941 | A | 9/1989 | Goulter |
| 4,883,314 | A | 11/1989 | Sakong |
| 4,903,686 | A | 2/1990 | Jennings |
| 4,951,576 | A | 8/1990 | Cobos et al. |
| 4,960,303 | A | 10/1990 | York |
| 4,998,395 | A | 3/1991 | Bezner |
| 5,007,673 | A | 4/1991 | Cheng |
| 5,009,170 | A | 4/1991 | Spehar |
| 5,014,628 | A | 5/1991 | Roberts |
| 5,018,785 | A | 5/1991 | Monson et al. |
| 5,029,938 | A | 7/1991 | Song |
| 5,060,902 | A | 10/1991 | Hartman |
| 5,070,664 | A | 12/1991 | Groh et al. |
| 5,109,778 | A | 5/1992 | Berkowitz et al. |
| 5,149,575 | A | 9/1992 | Soifer |
| 5,208,084 | A | 5/1993 | Rutz |
| 5,240,307 | A | 8/1993 | Jones et al. |
| 5,271,338 | A | 12/1993 | Bonham |
| 5,279,233 | A | 1/1994 | Cox |
| 5,284,100 | A | 2/1994 | Thorn |
| 5,314,231 | A | 5/1994 | Otterbacher |
| 5,323,713 | A | 6/1994 | Luyk et al. |
| 5,325,793 | A | 7/1994 | Martin |
| 5,335,594 | A | 8/1994 | Karlyn et al. |
| D350,862 | S | 9/1994 | Beller |
| 5,357,872 | A | 10/1994 | Wilmore |
| 5,377,601 | A | 1/1995 | Cashen |
| 5,394,808 | A | 3/1995 | Dutro et al. |
| 5,409,245 | A | 4/1995 | Kern et al. |
| 5,411,314 | A | 5/1995 | Wallace |
| 5,421,272 | A | 6/1995 | Wilmore |
| 5,440,857 | A | 8/1995 | Shanok et al. |
| 5,443,020 | A | 8/1995 | Price |
| 5,483,901 | A | 1/1996 | Tisbo et al. |
| 5,488,926 | A | 2/1996 | Hunt |
| 5,505,142 | A | 4/1996 | Fink |
| 5,536,552 | A | 7/1996 | Scripsick |
| 5,622,120 | A | 4/1997 | Yeh |
| 5,623,882 | A | 4/1997 | Price |
| 5,626,339 | A | 5/1997 | Schickert |
| 5,638,761 | A | 6/1997 | Berkowitz et al. |
| 5,678,491 | A | 10/1997 | Price et al. |
| 5,694,865 | A | 12/1997 | Raab |
| 5,730,066 | A | 3/1998 | Auten et al. |
| 5,732,637 | A | 3/1998 | Raab |
| 5,860,367 | A | 1/1999 | Riegel et al. |
| 5,865,128 | A | 2/1999 | Tarnay |
| 5,868,081 | A | 2/1999 | Raab |
| 5,909,021 | A | 6/1999 | Duffy |
| 5,921,623 | A | 7/1999 | Nye et al. |
| 5,947,037 | A | 9/1999 | Hornberger et al. |
| D414,626 | S | 10/1999 | Collins et al. |
| 5,983,807 | A | 11/1999 | Tarnay et al. |
| 5,984,047 | A | 11/1999 | Rogers |
| 6,000,345 | A | 12/1999 | Gillotti |
| D419,332 | S | 1/2000 | Collins et al. |
| D420,527 | S | 2/2000 | Pinch et al. |
| 6,032,585 | A | 3/2000 | Pinch |
| D423,258 | S | 4/2000 | Pinch |
| 6,058,853 | A | 5/2000 | Pinch |
| 6,076,472 | A | 6/2000 | Lloyd |
| 6,086,148 | A | 7/2000 | Gatto et al. |
| 6,109,687 | A | 8/2000 | Nye et al. |
| 6,112,674 | A | 9/2000 | Stanford |
| D442,788 | S | 5/2001 | Nye et al. |
| 6,334,400 | B1 | 1/2002 | Nien |
| 6,347,831 | B1 | 2/2002 | Nye et al. |
| 6,371,034 | B1 | 4/2002 | Simpson et al. |
| 6,431,092 | B1 | 8/2002 | Stanford |
| 6,530,331 | B2 | 3/2003 | Stanford |
| 6,550,404 | B2 | 4/2003 | Stanford |
| 6,615,743 | B2 * | 9/2003 | Nien ..... 108/132 |
| 6,622,644 | B2 | 9/2003 | Buono |
| 6,651,568 | B1 | 11/2003 | Buono |
| 6,823,806 | B1 | 11/2004 | Buono |
| 6,968,789 | B2 | 11/2005 | Baik et al. |
| 7,051,662 | B2 | 5/2006 | Shenghao et al. |
| 7,191,493 | B2 * | 3/2007 | Vanderpool et al. ..... 16/412 |
| 2002/0092445 | A1 | 7/2002 | Glover et al. |
| 2003/0127028 | A1 | 7/2003 | Baik et al. |
| 2003/0177962 | A1 | 9/2003 | Stanford |
| 2003/0233967 | A1 | 12/2003 | Lin |
| 2004/0083575 | A1 * | 5/2004 | Chou ..... 16/110.1 |
| 2004/0099189 | A1 | 5/2004 | Stanford |
| 2004/0187747 | A1 | 9/2004 | Shenghao et al. |
| 2004/0187748 | A1 | 9/2004 | Shenghao et al. |
| 2004/0194675 | A1 | 10/2004 | Shenghao et al. |
| 2004/0194677 | A1 | 10/2004 | Degen et al. |
| 2004/0237856 | A1 | 12/2004 | Shenghao et al. |
| 2004/0244656 | A1 | 12/2004 | Shenghao et al. |
| 2005/0045075 | A1 | 3/2005 | Stanford |
| 2005/0045076 | A1 | 3/2005 | Stanford |
| 2006/0070557 | A1 | 4/2006 | Baik et al. |

FOREIGN PATENT DOCUMENTS

| | | | |
|---|---|---|---|
| BE | 650758 | | 11/1964 |
| CA | 2166651 | | 7/1996 |
| CA | 2358307 | * | 4/2003 |
| CN | 2345061 | Y | 10/1999 |
| CN | 2439806 | Y | 7/2001 |
| CN | 2441358 | Y | 8/2001 |
| CN | 2461375 | Y | 11/2001 |
| CN | 2466970 | Y | 12/2001 |
| CN | 2520736 | Y | 11/2002 |
| CN | 2540123 | Y | 3/2003 |
| DE | 341007 | | 5/1920 |
| DE | 3705566 | | 9/1988 |
| EP | 0572331 | | 12/1933 |
| FR | 2553644 | | 4/1985 |
| FR | 2637474 | | 4/1990 |
| GB | 10007 | | 12/1908 |
| GB | 1457271 | | 12/1976 |
| GB | 1595210 | | 8/1981 |
| JP | H10-75825 | | 3/1998 |
| TW | 320006 | | 3/1997 |
| WO | WO 95/10204 | | 4/1995 |
| WO | WO 2004/028296 | A2 | 4/2004 |
| WO | WO 2004/032677 | A2 | 4/2004 |
| WO | WO 2004/037040 | A2 | 5/2004 |
| WO | WO 2004/058005 | A2 | 7/2004 |
| WO | WO 2004/037040 | A3 | 8/2004 |
| WO | WO 2004/028296 | A3 | 9/2004 |
| WO | WO 2004/032677 | A3 | 10/2004 |
| WO | WO 2004/058005 | A3 | 10/2004 |

OTHER PUBLICATIONS

*International Preliminary Report on Patentability*; International Application No. PCT/IB03/05419 (published as WO 2004/032677); 3 pages.

*International Preliminary Report on Patentability*; International Application No. PCT/IB03/05406 (published as WO 2004/037040); 3 pages.

*International Preliminary Report on Patentability*; International Application No. PCT/IB03/06466 (published as WO 2004/058005); 3 pages.

* cited by examiner

TABLE HAVING H-CENTER SUPPORT ASSEMBLY

CROSS-REFERENCE TO RELATED APPLICATIONS

This application claims priority to and benefit of Chinese Application No. 02259585.6 filed Sep. 27, 2002 and entitled "A Type of Folding Table," which application is incorporated herein by reference in its entirety.

BACKGROUND OF THE INVENTION

1. Field of the Invention

The present invention generally relates to furniture such as tables and, in particular, to tables having a central plane supporting structure.

2. Description of Related Art

As modern furniture, whether for home or office, becomes more practical, the demands for functionality have been increasing. For example, folding furniture has become more in demand. The kind of folding furniture that has received the most attention are tables and chairs.

A conventional folding table that can be used, for example, for outdoor activities is shown in FIG. 1. Its main components include a table top 1' and table frame 2'. As shown in the accompanying figure, the table frame 2' includes two side rails 21', three cross bars 22', two sets of foldable legs 23', and two support braces 24'. The side rails 21' are fastened to the underside of the table top 1'. The three cross bars 22' are separately and pivotally attached to both ends and the middle portion of the side rails 21'. The two sets of table legs 23' are separately fastened to the ends of the end rails 22'. One end of the support braces 24' is fastened to the table legs 23' and the other end of the support braces is pivotally attached to the cross bar 22' which is attached to the center portion of the side rails 21'.

When folding the table legs 23' of the conventional table shown in FIG. 1 into the collapsed position, one turns the table top 1' so that the underside of the table top is facing upwards. The table legs 23' are then folded downwardly towards the table top. Because the cross bars 22' that are fastened to the table legs 23' are pivotally attached to the side rails 21', and the support braces 24' are pivotally attached to the table legs 23', the table legs 23' come to rest on the underside of the table top 1', thus reducing its volume.

The center portion of the table top 1' of this type of conventional folding table, however, is only supported by one cross bar 22' that pivotally attached to the two support braces 24'. This may allow the center portion of the table to undesirably deflect, shift or move. In addition, if the cross bar 22' in the center portion of the table top is damaged, the entire table frame 2' must be removed in order to allow repair or replacement of the damaged cross bar. Removing the entire table frame 2' from the table top 1' often requires a significant amount of time and effort.

BRIEF SUMMARY OF THE INVENTION

A need therefore exists for a table that eliminates the above-described disadvantages and problems.

One aspect of the invention is a folding table that has strong support and that is easy to maintain. The folding table, for example, may include a table top with a top surface and a bottom surface; a mounting structure centrally disposed on the bottom surface of the table top; a support assembly at least partially connected to the mounting structure; and a frame assembly including a first leg connected to the bottom surface of the table top; and a support brace having a first end and a second end, the first end being attached to the first leg and the second end being attached to the support assembly.

The mounting structure may include a pair of C-shaped mounting ridges formed on the bottom surface of the table top.

The support assembly may include a pair of spaced apart side rails configured to be attached to the mounting structure; and a first cross bar disposed transverse to the pair of side rails.

The support assembly may include a pair of spaced apart side rails configured to be attached to the mounting structure; and a pair of spaced apart end rails disposed transverse to the pair of side rails.

The support assembly may be formed integrally with the table top.

The table top may be formed of blow-molded plastic.

The mounting structure may be formed of blow-molded plastic.

The frame assembly may include a pair of spaced apart side rails and a pair of spaced apart end rails disposed transversely to the pair of side rails and connected therebetween, wherein the table leg is connected to one of the pair of end rails.

When the above-described structure is adopted, the center of this table is supported by the central support assembly. Preferably, the central support assembly is pivotally attached to the support braces. Advantageously, the central support assembly in conjunction with the mounting structure provides a "planar" support strength that may be greater than the "linear" support strength of conventional tables. In addition, if the central support assembly is damaged, all that is required is to detach it from the mounting structure to repair it. It is not necessary to detach the parts of the outer support assembly, and thus less time and effort is required for maintenance.

These and other aspects, features and advantages of the present invention will become more fully apparent from the following detailed description of preferred embodiments and appended claims.

BRIEF DESCRIPTION OF THE DRAWINGS

The appended drawings contain figures of preferred embodiments to further clarify the above and other aspects, advantages and features of the present invention. It will be appreciated that these drawings depict only preferred embodiments of the invention and are not intended to limits its scope. The invention will be described and explained with additional specificity and detail through the use of the accompanying drawings in which.

DETAILED DESCRIPTION OF THE PREFERRED EMBODIMENTS

The present invention is generally directed to structures having reinforced center regions provided by a generally "H"-shaped center support. Advantageously, the "H"-shaped center support may provide a "planar" support structure versus the "linear" support structure that was provided in conventional tables. The "H"-shaped center support may provide added strength to the structure, whether the structure is a table, chair, shelf, or other type of furniture. While the present invention is described with relation to a folding table, it will be appreciated that the "H"-shaped center support may be used in connection with other suitable types structures.

Figure 1:
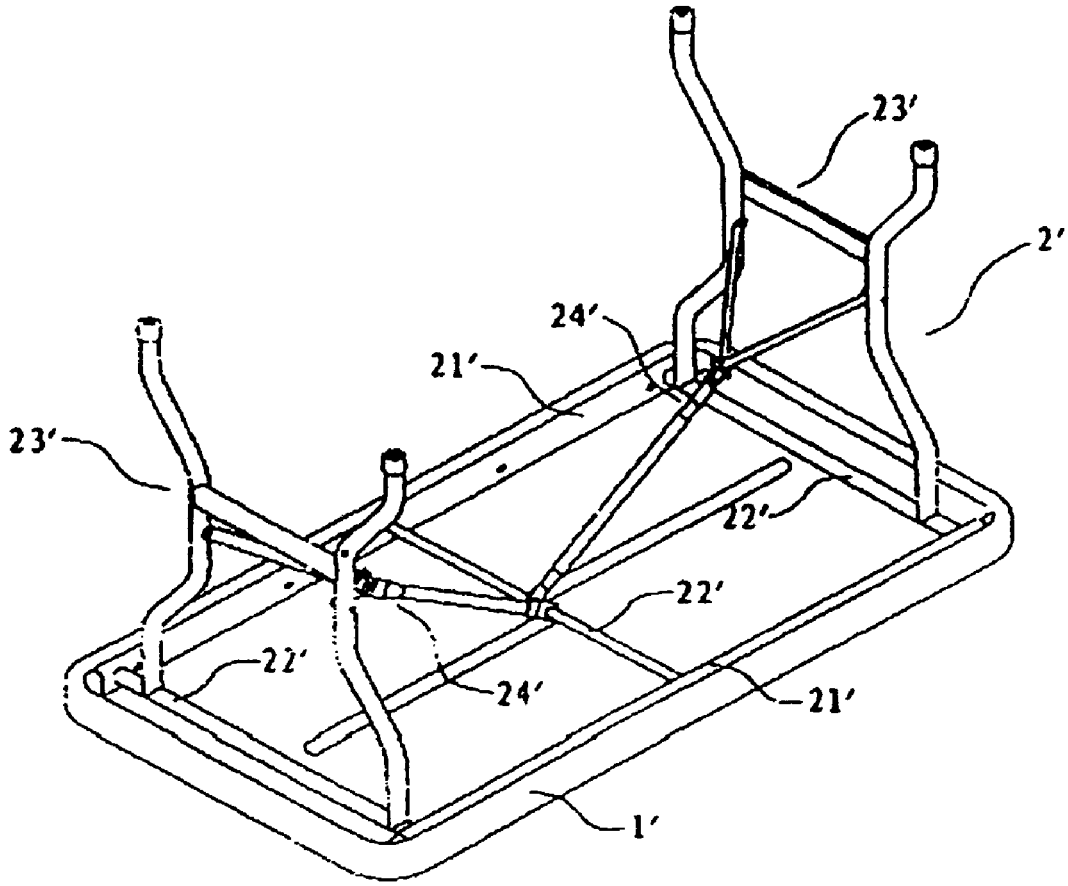
FIG. 1 (PRIOR ART)
FIG. 1 is a perspective view of a conventional folding table with legs that are pivotally attached to a table frame.
Figure 2:
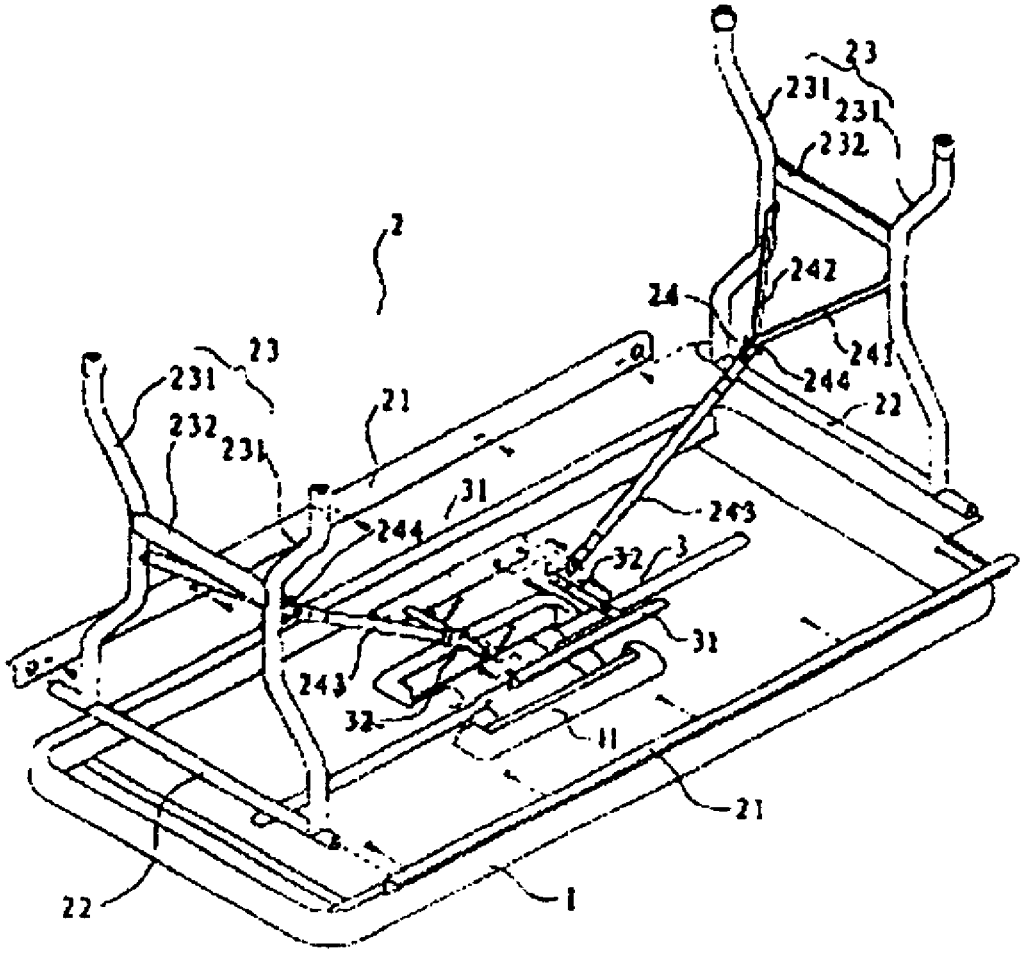
FIG. 2 is an exploded perspective view of a folding table in accordance with a preferred embodiment of the present invention.
Figure 3:
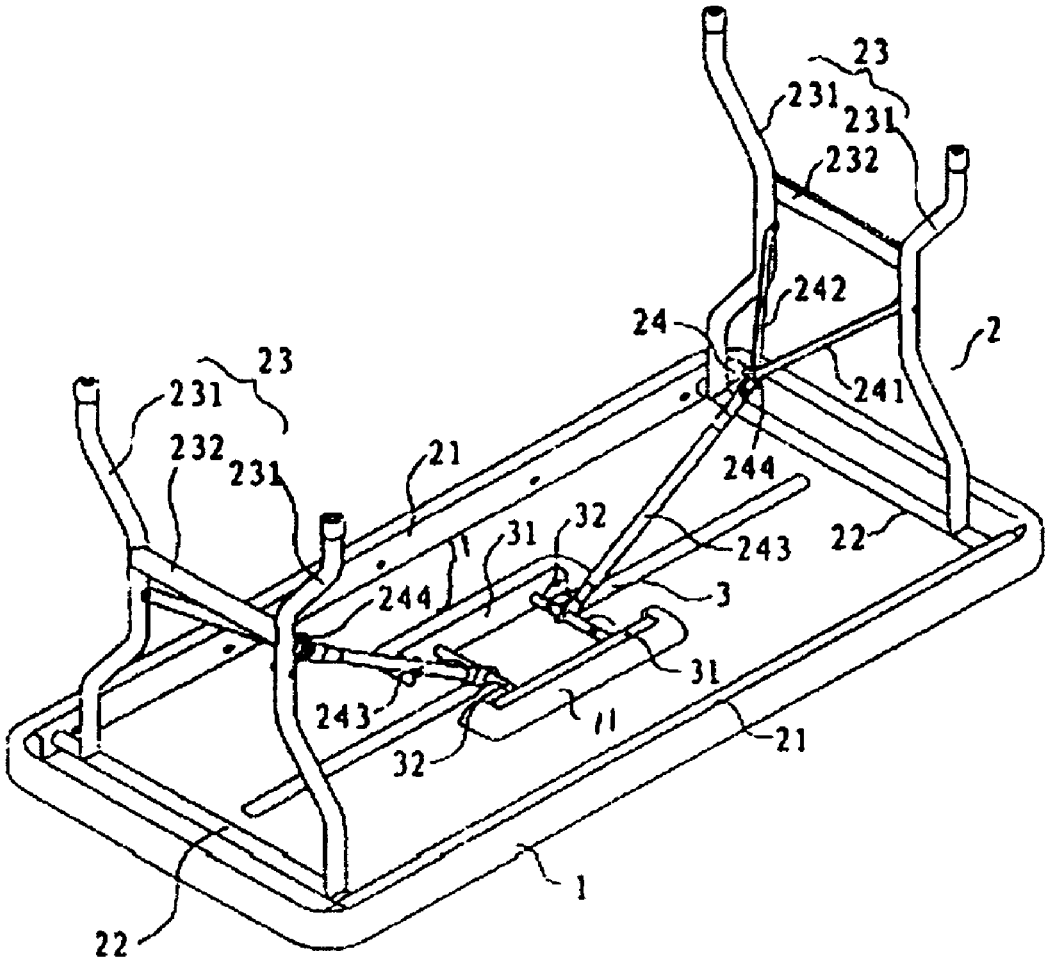
FIG. 3 is a perspective view of the folding table shown in FIG. 2, illustrating the legs in an extended position.

As shown in FIGS. 2 and 3, an exemplary folding table includes a table top 1, a table frame 2, and a support assembly 3. Table top 1 can be constructed out of plastic such as, but not limited to, blow molded plastic or injection molded plastic. Other suitable materials include, but are not limited to wood and metal.

Table frame 2 includes two spaced apart side rails 21, two spaced apart cross bars or end rails 22 that are connected to the side rails, two sets of table legs 23 connected to the end rails, and two support braces 24. Each side rail 21 is fastened to the underside of one side of table top 1. The side rails 21 include connecting apertures at each end. An end rail 22 is disposed in the facing connecting apertures of a pair of side rails 21.

Each table leg set 23 includes a pair of table legs 231 and a cross bar 232. One end of each table leg set 23 is fastened to an end rail 22. The support braces 24 are constructed from three support bars 241, 242, and 243. One end of the first and second support bars 241 and 242 is separately and pivotally attached to the lower part of the two table legs 231. The other ends converge and are pivotally attached to one end of the third support bar 243. The pivot area on this third support bar 243 is encircled by a sliding locking ring 244 so that, when the table is supported, the force of gravity detains the first and second support bars 241 and 242, preventing the table legs 23 from folding and thus increasing the firmness of the table legs 23. The other end of the third support bar 243 is pivotally attached to the support assembly 3.

A mounting structure 11 is formed on the underside of the table top 1. In one embodiment, the mounting structure 11 includes a pair of generally C-shaped mounting ridges each mounting ridge having an elongate central portion and two shorter end portions. The mounting ridges face each other so that a box-like region is formed at the center of table top 1.

The mounting structure 11 can be formed integrally with table top 1 during the blow-molded process or injection molding process to form a one-piece structure. Thus, the mounting structure 11 is formed in a single step and does not require additional manufacturing or cooling time. Alternatively, the mounting structure 11 could be formed from discrete parts and later attached or adhered to table top 1. The mounting structure 11 is configured to support at least a portion or the entire support assembly 3.

The support assembly 3 is preferably constructed with a generally "H"-shape configuration with two side rails 31 and two cross bars or end rails 32. Each side rail 31 is desirably attached to the inside surface of a mounting ridge of the mounting structure 11. The side rails 31 include connecting apertures at each end. An end rail 32 is disposed in the facing connecting apertures of a pair of side rails 31. An end of the third support bar 243 of a support brace 24 is pivotally attached to an end rail 32. One skilled in the art will appreciate that the support assembly 3 could have other suitable shapes and configurations depending, for example, upon the intended use of the table.

Because the support assembly 3 has a generally "H"-shaped structure, the support assembly 3 provides a "planar" support structure to the central portion of table top 1. It will be appreciated that the generally "H"-shaped structure of the support assembly 3 may be formed from two side rails 31 and two end rails 32 or from a single end rail 32 disposed between a pair of end rails 31 (forming a true "H"). A "planar" support structure distributes forces along the plane. In contrast, the center portion of a conventional table top was often supported by a "linear" structure in which the forces were focused along a central line. Thus, failure of the table top 1 is more likely with a "linear" structure than with a "plane" structure. Therefore, the embodiments of the present invention provide unique mounting structures for support braces 24 which ultimately provide greater support strength for the table top 1.

In addition, when support assembly 3 is damaged, it can be replaced or repaired simply by detaching the two side rails 31. Thus, there is no need to go to the trouble of disassembling the entire table frame 2. Furthermore, the ridge-shaped nature of the mounting ridges provides that fastening structure such as bolts, rivets, nails and the like are protected from exposure. Of course, any suitable type of fastener or connectors could be used to attached the support assembly 3 to the table or assemble the table.

Figure 4:
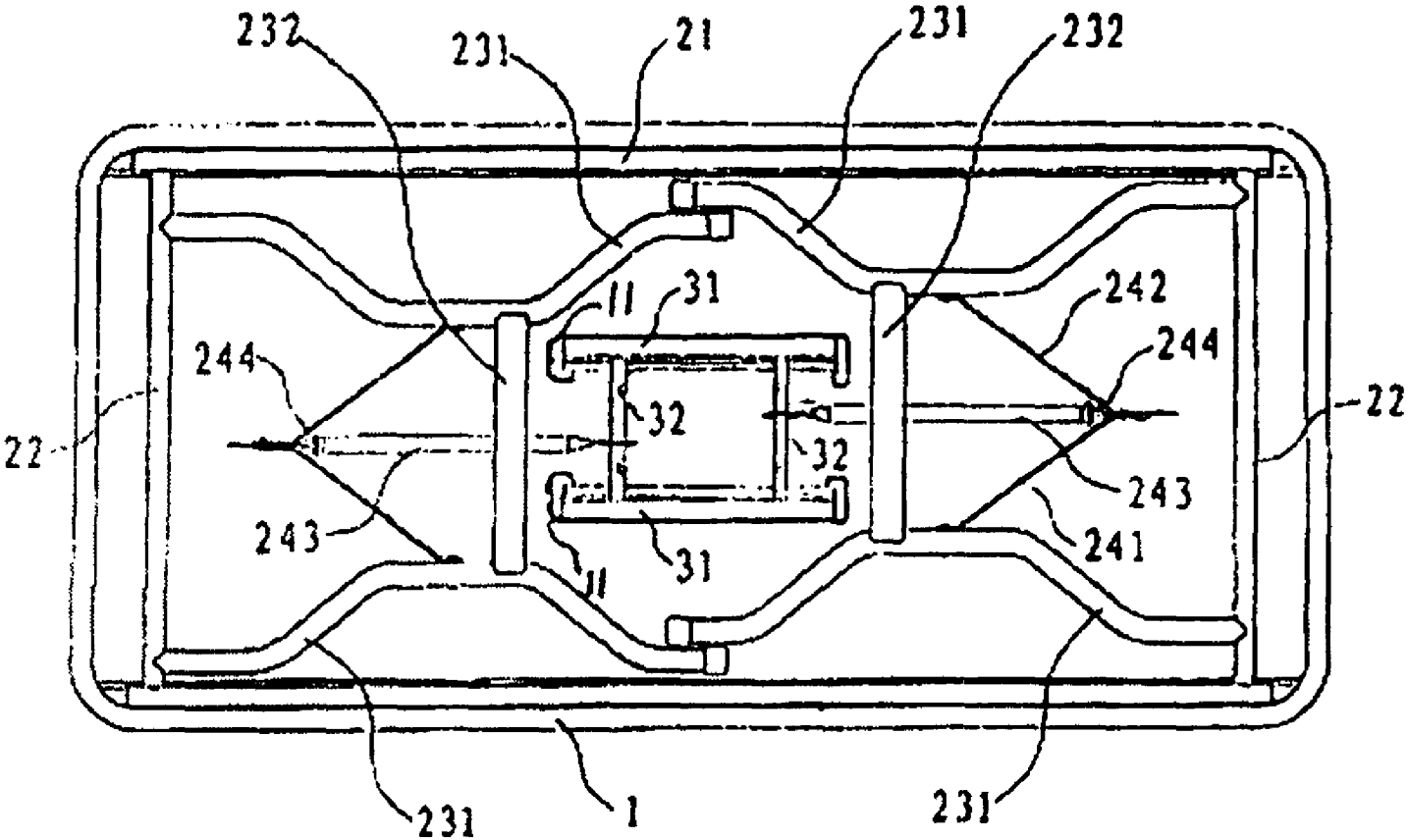
FIG. 4 is a top view of the folding table shown in FIG. 2, illustrating the legs in a collapsed or folded position.

In order to fold the table into the collapsed or storage position, as shown in FIG. 4, the table is preferably turned upside down with the underside facing up. Under the effect of gravity, the locking ring 244 may automatically slide down under the effect of its own weight and will remove the constraint on the pivoting region of the support braces 24. Applying force to the pivoting region folds the two sets of table legs 23 in a downwards direction. The table legs 23 will come to rest on the underside of the table top 1, thus facilitating storage or transport.

It will be appreciated that the "H"-shaped support assembly may be used in any table or structure requiring such support. For example, the "H"-shaped support structure may be used in non-folding tables. It may also be used for other structure including chairs, shelving, and the like. Further, depending upon the type of structure used in connection with the support assembly, the support assembly could have other suitable shapes, sizes and configurations.

Although this invention has been described in terms of certain preferred embodiments, other embodiments apparent to those of ordinary skill in the art are also within the scope of this invention. Accordingly, the scope of the invention is intended to be defined only by the claims which follow.

What is claimed is:

1. A table comprising:

a table top having a top surface and a bottom surface;

a mounting structure centrally disposed on the bottom surface of the table top, the mounting structure including a first generally C-shaped portion including an elongated center section with a first end, a second end and an at least substantially planar attachment surface that is disposed generally perpendicular to the bottom surface of the table top, a first end portion connected to the first end of the elongated central portion and a second end portion connected to the second end of the elongated central portion, and a second generally C-shaped portion including an elongated center section with a first end, a second end and an at least substantially planar attachment surface that is disposed generally perpendicular to the bottom surface of the table top, a first end portion connected to the first end of the elongated central portion and a second end portion connected to the second end of the elongated central portion;

a central box-like region disposed in the bottom surface of the table top and being defined by the elongated center sections, the first end portions and the second end portions of the first and second generally C-shaped portions;

a support assembly at least partially connected to the mounting structure, the support assembly comprising:

a first elongated support member including an at least substantially planar attachment surface that is attached to the at least substantially planar attachment surface of the center section of the first generally C-shaped portion of the mounting structure, a first end of the first elongated support member being disposed proximate the first end of the center section of the first generally C-shaped portion and a second end of the first elongated support member being disposed proximate the second end of the center section of the first generally C-shaped portion;

a second elongated support member including an at least substantially planar attachment surface that is attached to the at least substantially planar attachment surface of the center section of the second generally C-shaped portion of the mounting structure, the second support member being spaced apart from the first support member, a first end of the second elongated support member being disposed proximate the first end of the center section of the second generally C-shaped portion and a second end of the second elongated support member being disposed proximate the second end of the center section of the second generally C-shaped portion; and a first connecting member connected to a center section of the first support member and a center section of the second support member, the first connecting member being disposed inwardly and away from the first end of the center section of the first support member and the first end of the center section of the second support member;

a first leg connected to the table top and movable between a use position and a storage position; and a first support brace including a first portion and a second portion, the first portion being attached to the first leg and the second portion being attached to the first connecting member of the support assembly;

wherein no portion of the mounting structure is disposed between the first elongated support member and the second elongated support member of the support assembly;

wherein no portion of the mounting structure contacts the first connecting member of the support assembly between the first elongated support member and the second elongated support member of the support assembly; and wherein the bottom surface of the table top disposed between the first generally C-shaped portion and the second generally C-shaped portion of the mounting structure has a generally planar configuration with no outwardly extending portions.

2. The table as recited in claim 1, wherein a body of the first connecting member is completely disposed between the first elongated support member and the second elongated support member.

3. The table as recited in claim 1, wherein the mounting structure is formed integrally with the table top.

4. The table as recited in claim 1, wherein the table top is formed of blow-molded plastic.

5. The table as recited in claim 1, wherein the mounting structure is formed of blow-molded plastic.

6. The table as in claim 1, further comprising a second connecting member connected to a center section of the first support member and a center section of the second support member, the second connecting member being disposed inwardly and away from the second end of the first support member and the second end of the second support member;

a second leg connected to the table top and movable between a use position and a storage position; and a second support brace including a first portion and a second portion, the first portion being attached to the second leg and the second portion being attached to the second connecting member of the support assembly.

7. A table comprising:

a table top including a top portion and a bottom portion;

a table frame attached to the table top, the table frame including a first elongated frame member and a second elongated frame member;

a first leg assembly attached to the first elongated frame member and the second elongated frame member, the first leg assembly being movable between a use position and a storage position relative to the table top;

a second leg assembly attached to the first elongated frame member and the second elongated frame member, the second leg assembly being movable between a use position and a storage position relative to the table top;

a mounting structure formed in the bottom surface of the table top, the mounting structure comprising:

a first generally C-shaped portion including an elongated center section with an at least substantially planar attachment surface that is disposed generally perpendicular to the bottom portion of the table top, a first end portion connected to a first end of the elongated central portion and a second end portion connected to a second end of the elongated central portion;

a second generally C-shaped portion including an elongated center section with an at least substantially planar attachment surface that is disposed generally perpendicular to the bottom portion of the table top, a first end portion connected to a first end of the elongated central portion and a second end portion connected to a second end of the elongated central portion; and a central box-like region disposed in the bottom surface of the table top and defined by the elongated center sections, the first end portions and the second end portions of the first and second generally C-shaped portions;

a support assembly at least partially disposed between the first leg assembly and the second leg assembly, the support assembly comprising:

a first elongated support member including a first end, a second end and an at least substantially planar attachment surface that is attached to the at least substantially planar attachment surface of the elongated center section of the first generally C-shaped portion of the mounting structure;

a second elongated support member including a first end, a second end and an at least substantially planar attachment surface that is attached to the at least substantially planar attachment surface of the elongated center section of the first generally C-shaped portion of the mounting structure, the second elongated support member being spaced apart from the first support member;

a first connecting member connected to the first support member and the second support member, a portion of the first connecting member being disposed in a first opening of the first elongated support member and a portion of the first connecting member being disposed in a first opening of the second elongated support member, the first opening of the first elongated support member being disposed away from and spaced apart from the first end and the second end of the first elongated support member, the first opening of the second elongated support member being disposed away from and spaced apart from the first end and the second end of the second elongated support member; and a second connecting member connected to the first support member and the second support member, a portion of the second connecting member being disposed in a second opening of the first elongated support member and a portion of the second connecting member being disposed in a second opening of the second elongated support member, the second opening of the first elongated support member being disposed away from and spaced apart from the first end and the second end of the first elongated support member, the second opening of the second elongated support member being disposed away from and spaced apart from the first end and the second end of the second elongated support member; and a first support brace connected to the first leg assembly and the first connecting member of the support assembly;

wherein no portion of the mounting structure is disposed between the first elongated support member and the second elongated support member of the support assembly;

wherein no portion of the mounting structure is disposed between the first connecting member and the second connecting member of the support assembly; and wherein the bottom surface of the table top disposed between the first generally C-shaped portion and the second generally C-shaped portion of the mounting structure has a generally planar configuration with no outwardly extending portions.

8. The table as recited in claim 7, wherein the mounting structure is integrally formed in the bottom portion of the table top.

9. A table comprising:

a table top constructed from blow-molded plastic, the table top including an upper portion and a lower portion;

a table frame connected to the table top, the table frame including a first frame member and a second frame member;

a first leg assembly movable between a use position and a storage position relative to the table top;

a second leg assembly movable between a use position and a storage position relative to the table top;

a mounting structure formed in the lower portion of the table top, the mounting structure comprising:

a first generally C-shaped portion including an elongated center section with an at least substantially planar attachment portion that is disposed generally perpendicular to the lower portion of the table top, a first end portion connected to a first end of the elongated central portion and a second end portion connected to a second end of the elongated central portion;

a second generally C-shaped portion including an elongated center section with an at least substantially planar attachment portion that is disposed generally perpendicular to the lower portion of the table top, a first end portion connected to a first end of the elongated central portion and a second end portion connected to a second end of the elongated central portion; and a central box-like region defined by the elongated center sections, the first end portions and the second end portions of the first and second generally C-shaped portions;

a support assembly at least partially disposed between the first leg assembly and the second leg assembly, the support assembly comprising:

a first support member including an at least substantially planar attachment portion that is connected to the at least substantially planar attachment portion of the first generally C-shaped portion of the mounting structure, a first end of the first support member being disposed at least proximate the first end of the attachment portion of the first mounting structure, a second end of the first support member being disposed at least proximate the second end of the attachment portion of the first mounting structure;

a second support member including an at least substantially planar attachment portion that is connected to the at least substantially planar attachment portion of the second generally C-shaped portion of the mounting structure, a first end of the second support member being disposed at least proximate the first end of the attachment portion of the second mounting structure, a second end of the second support member being disposed at least proximate the second end of the attachment portion of the second mounting structure;

a first connecting member connected to the first support member and the second support member of the support assembly, a portion of the first connecting member being disposed in a first opening of the first support member and a portion of the first connecting member being disposed in a first opening of the second support member, the first opening of the first elongated support member being disposed away from and spaced apart from the first end of the first elongated support member, the first opening of the second elongated support member being disposed away from and spaced apart from the first end of the second elongated support member; and a second connecting member connected to the first support member and the second support member of the support assembly, a portion of the second connecting member being disposed in a second opening of the first support member and a portion of the second connecting member being disposed in a second opening of the second support member, the second opening of the first elongated support member being disposed away from and spaced apart from the second end of the first elongated support member, the second opening of the second elongated support member being disposed away from and spaced apart from the second end of the second elongated support member;

a first support brace connected to the first leg assembly and the first connecting member of the support assembly; and a second support brace connected to the second leg assembly and the second connecting member of the support assembly;

wherein no portion of the mounting structure is disposed between the first support member and the second support member of the support assembly;

wherein no portion of the mounting structure is disposed between the first connecting member and the second connecting member of the support assembly; and wherein the bottom surface of the table top disposed between the first generally C-shaped portion and the second generally C-shaped portion of the mounting structure has a generally planar configuration with no outwardly extending portions.

10. The table as recited in claim 9, wherein the first support member, the second support member, the first connecting member and the second connecting member are constructed from metal.

11. The table as recited in claim 9, wherein the first generally C-shaped mounting structure has an elongated body, a first end and a second end; and wherein the second generally C-shaped mounting structure has an elongated body, a first end and a second end.

12. The table as recited in claim 11, wherein the attachment portion of the first mounting structure includes an inner surface of the elongated body; and wherein the attachment portion of the second mounting structure includes an inner surface of the elongated body.

* * * * *

UNITED STATES PATENT AND TRADEMARK OFFICE

CERTIFICATE OF CORRECTION

PATENT NO. : 7,475,642 B2 
APPLICATION NO. : 10/669740
DATED : January 13, 2009
INVENTOR(S) : Shenghao et al.

It is certified that error appears in the above-identified patent and that said Letters Patent is hereby corrected as shown below:

Title Page
(30) Foreign Application Priority Data, change "02 2 59585 U" to --02259585.6--

Drawings
Replace Figure 2 with the figure depicted herein below, wherein where the instance of "231" had a broken line to the table leg, the broken line has been changed to an unbroken line

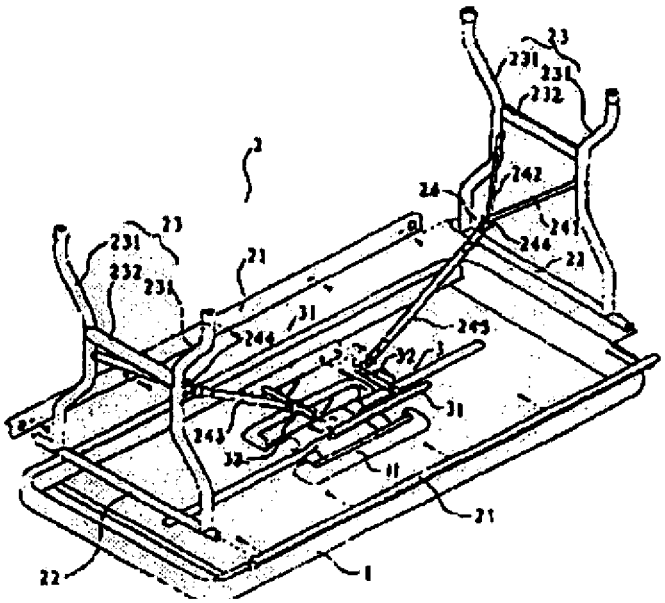

Column 1
Line 22, change "kind" to --kinds--
Line 22, change "has" to --have--
Line 49, change "that pivotally" to --that is pivotally--

UNITED STATES PATENT AND TRADEMARK OFFICE

CERTIFICATE OF CORRECTION

PATENT NO. : 7,475,642 B2
APPLICATION NO. : 10/669740
DATED : January 13, 2009
INVENTOR(S) : Shenghao et al.

It is certified that error appears in the above-identified patent and that said Letters Patent is hereby corrected as shown below:

Column 2
Line 47, change "limits" to --limit--

Column 4
Line 2, change "end rails" to --side rails--
Line 15, change "structure" to --structures--
Line 34, change "structure" to --structures--

Signed and Sealed this

Sixth Day of October, 2009

David J. Kappos

David J. Kappos
*Director of the United States Patent and Trademark Office*